US010098451B2

(12) United States Patent
Keller

(10) Patent No.: US 10,098,451 B2
(45) Date of Patent: Oct. 16, 2018

(54) HEIGHT-ADJUSTABLE TABLE

(71) Applicant: Vitra Patente AG, Birsfelden (CH)

(72) Inventor: Stefan Keller, Steinen-Hofen (DE)

(73) Assignee: VITRA PATENTE AG, Birsfelden (CH)

( * ) Notice: Subject to any disclaimer, the term of this patent is extended or adjusted under 35 U.S.C. 154(b) by 0 days.

(21) Appl. No.: 15/357,526

(22) Filed: Nov. 21, 2016

(65) Prior Publication Data

US 2017/0150811 A1 Jun. 1, 2017

(30) Foreign Application Priority Data

Nov. 26, 2015 (EP) ..... 15196558

(51) Int. Cl.
*A47B 9/02* (2006.01)
*A47B 9/12* (2006.01)
*A47B 21/02* (2006.01)

(52) U.S. Cl.
CPC ..... *A47B 9/12* (2013.01); *A47B 9/02* (2013.01); *A47B 21/02* (2013.01)

(58) Field of Classification Search
CPC .... B65G 1/07; A47B 9/12; A47B 9/02; A47B 21/02
USPC ..... 108/136, 147; 312/306, 312, 29, 25
See application file for complete search history.

(56) References Cited

U.S. PATENT DOCUMENTS 918,240 A * 4/1909 Wheeler ..... A47C 9/08 108/147
1,229,620 A * 6/1917 Klimo ..... A47B 21/02 312/25
2,575,725 A * 11/1951 McKay ..... A47B 51/00 108/96

(Continued)

FOREIGN PATENT DOCUMENTS

DE 1 554 360 11/1969
DE 3439361 * 4/1986

(Continued)

OTHER PUBLICATIONS

KR 1756597; Danjeong et al ; Jul. 2017.*
European Search Report issued in EP Application No. 15196558.9, dated May 6, 2016.

*Primary Examiner* — Janet M Wilkens
(74) *Attorney, Agent, or Firm* — Medler Ferro Woodhouse & Mills PLLC

(57) ABSTRACT

A table with a height-adjustable table top, supporting structures and at least one strap that connects the supporting structures and the table top together, so that the table top is supported by being suspended by the strap on the supporting structures. The table includes a mechanism for manually adjusting the height of the table top that includes a winding disk rotatably mounted relative to the table top, and a spring element non-positively connected to the winding disk, wherein the strap is connected to the winding disk. The table top is adjustable between a lower height in which the strap is minimally wound onto the winding disk and an upper (Continued)

height in which the strap is maximally wound onto the winding disk. The spring element is maximally tensioned when the table top is at the lower height and is minimally tensioned when the table top is at the upper height.

18 Claims, 4 Drawing Sheets

(56) References Cited

U.S. PATENT DOCUMENTS 3,381,634 A * 5/1968 Rothschild ..... B65G 1/07 108/136
3,415,586 A * 12/1968 Hammond ..... A47B 51/00 108/147
3,454,317 A * 7/1969 Salkind ..... A47B 37/02 312/21
4,651,652 A * 3/1987 Wyckoff ..... A47B 9/10 108/147
4,790,611 A * 12/1988 Craner ..... A47B 57/00 108/147
5,129,611 A * 7/1992 Grover ..... F16M 11/42 108/147
5,273,352 A * 12/1993 Saper ..... A47B 51/00 312/312
5,287,815 A * 2/1994 Gross ..... A47B 21/00 108/50.01
5,450,800 A * 9/1995 Leonard ..... A47B 21/0073 108/7
9,723,919 B1 * 8/2017 Randolph ..... A47B 21/02

FOREIGN PATENT DOCUMENTS

EP 2946689 * 11/2015
FR 2007844 * 1/1970
FR 2 243 143 4/1975

* cited by examiner

HEIGHT-ADJUSTABLE TABLE

TECHNICAL FIELD

The invention relates to a table with a height-adjustable table top, supporting structures and at least one strap, in which the at least one strap connects the supporting structures and the table top together so that the table top is supported by the supporting structures, by said table top being suspended by means of the at least one strap on the supporting structures, may be used as work tables in office spaces, for example. In particular, such tables are suitable for work stations where working both in the standing and seated positions is intended to be possible in a simple manner and/or where the users frequently alter the tables.

BACKGROUND

Nowadays height-adjustable tables are increasingly used, including in situations where the users are active for relatively long periods of time at the table. For health reasons and also for reasons of comfort, attempts are increasingly being made to permit alterations to the position of the users, where the tables are used for relatively long periods of time. In this case, it has proved expedient, in particular, to design tables such that the users are able to use the tables in both the seated and standing positions.

A further purpose of height-adjustable tables is to permit several users to be able to use a table and yet for this table to be adjusted in each case so as to be adapted to the respective user. For example, in working conditions where work stations are shared by several people, the individual requirements of the users may be taken into account by means of height-adjustable tables. Both in such working conditions and in other uses, it is also often desirable that the tables are able to be stowed in a simple and space-saving manner.

Height-adjustable tables—as is also the case in other tables—generally have a horizontal table top and a plurality of, for example, lateral, semi-vertical supporting structures. The supporting structures may, for example, be table legs, floor mounting brackets or similar structures which support the table top. The supporting structures in this case are connected to the table tops, wherein the table top may be screwed or plugged, in particular, onto the supporting structures or even suspended thereon via straps. In order to permit an adjustability of the height of the table top, nowadays supporting structures are frequently provided with a mechanism which permits a vertical displacement of the table top. For example, supporting structures with ratcheted rails are known, wherein the table top is connected via the rails to the supporting structures. For adjusting the table top height, the table top is moved along the rails and latched at a preferred point.

In order to permit a convenient stepless height adjustment of the table tops, nowadays hydraulic systems are also used in the mechanisms of the supporting structures. In this case the hydraulic system connects the table top to the associated supporting structure. For adjusting the table top height, the hydraulic system is actuated, which moves the table top into the desired position. Typically, however, supporting structures with hydraulic mechanisms are relatively cumbersome and heavy. In particular, in tables which are intended to be of flexible use, tables with such supporting structures frequently do not satisfy the requirements of being able to be stowed or transported in a simple and compact manner.

Height-adjustable tables of the type described above are frequently also provided with a motor which drives the mechanism for the height adjustment of the table top. Such motors are typically also relatively heavy and cumbersome. Additionally, they are typically operated by electrical current and accordingly require a connection to a mains power network. This further limits the flexibility of the use of the tables.

The object of the present invention, therefore, is to propose a table in which the height of its table top is able to be adjusted conveniently and efficiently in a stepless manner or manually in a finely stepped manner. Additionally, a further object is to permit the table to be able to be stowed efficiently and in a space-saving manner.

SUMMARY OF THE INVENTIONS

The essential idea of the invention is as follows: in a table with a height-adjustable table top, supporting structures and at least one strap, the at least one strap connects the supporting structures and the table top together, so that the table top is supported by the supporting structures, by said table top being suspended by means of the at least one strap on the supporting structures. The table comprises a mechanism for manually adjusting the height of the table top, said mechanism comprising a winding disk and a spring element. The winding disk is rotatably mounted relative to the table top. The spring element is non-positively connected to the winding disk. The at least one strap is connected to the winding disk such that it is able to be wound up onto the winding disk. The table top is adjustable between a lower height in which the at least one strap is wound up to a minimum extent onto the winding disk and an upper height in which the at least one strap is wound up to a maximum extent onto the winding disk. The spring element is tensioned and/or deflected to a maximum extent when the table top is located at the lower height and tensioned to a minimum extent when the table top is located at the upper height.

The supporting structures, in particular, are able to be positioned on a floor. They may comprise one leg or a plurality of legs. They may also be configured as side walls or the like. They may be produced from a solid stable material, such as for example metal, wood or a solid plastics. Additionally, they may have feet by which they are able to be positioned on the floor in a stable manner.

In connection with the spring element and the winding disk the term "non-positively connected" may refer to a spring force assisting a rotation of the winding disk in one rotational direction. In this case, a rotation of the winding disk in an opposing rotational direction may effect a tensioning of the spring element. The rotation of the winding disk in the opposing rotational direction thus runs counter to the spring force.

The term "rotational direction" in connection with the winding disk may refer to the directions about which the winding disk, in particular, is able to be rotated for winding up the at least one strap. Typically, the winding disk is able to be rotated about an axis which is located at right angles to the two surfaces of the winding disk. The rotational directions may be specified by "clockwise" and "counter-clockwise"

The term "wind up" in connection with the winding disk and the at least one strap may refer to increasingly more strap being wound up onto the winding disk. Accordingly, in this sense before being wound up, less strap is arranged around the winding disk than after being wound up. Similarly, the term "unwind" in connection with the winding disk and the at least one strap may refer to increasingly less strap being wound up onto the winding disk. Accordingly, in this sense before being unwound, more strap is arranged around the winding disk than after being unwound.

The term "wound up to a maximum extent" in connection with the at least one strap may refer to the strap not being wound up more onto the winding disk in any other position and/or height of the table top. Obviously, in the same connection, the term "wound up to a minimum extent" may refer to the at least one strap not being wound up less onto the winding disk in any other position and/or height of the table top. In the minimum wound-up position, however, the strap may still be wound up onto the winding disk to a certain extent. Therefore, the strap does not necessarily have to be completely unwound in the minimum wound-up position. The maximum wound-up state of the strap is different from the minimum wound-up state of the strap. In particular, more strap is wound up onto the winding strap when the strap is wound up to a maximum extent, than when the strap is wound up onto the winding disk to a minimum extent. As a result, when the strap is wound up to a maximum extent, an effective strap length which fixes the height of the table top may be shorter than when the strap is wound up to a minimum extent.

The term "tensioned to a maximum extent" in connection with the spring element may refer to the spring element not being more tensioned in any other position and/or height of the table top. Obviously, in the same connection the term "tensioned to a minimum extent" may refer to the spring element not being less tensioned in any other position and/or height of the table top. In the minimum tensioned position, however, the spring element may still be tensioned and/or pretensioned to a certain extent.

By the term "strap" may be understood, in particular, a textile or other woven fabric with a defined width and any length. Frequently such straps comprise relatively strong longitudinal selvages. Straps of such a type are, for example, also used as webbing for roller blinds, as safety belts in the transport field or as tensioning belts in the transport field. In connection with the invention the term "strap" may also comprise unwoven belts, such as for example belts made from leather or plastics. It may also refer to cables and/or cords, or the like.

In connection with the table top, by the term "height-adjustable" may be understood that the height of the table top and/or the distance of the table top from the floor on which the table stands may be adjusted by a user of the table. In particular, the height of the table top may be adjusted whilst it is aligned horizontally. To this end, the table comprises the mechanism as an adjusting mechanism. "Not height-adjustable" in this sense can mean when the table has to be at least partially dismantled and has to be reassembled in order to alter the height of the table top. A tool is typically used for such a dismantling and reassembly process, which is not understood within the meaning of the present invention as height adjustment, and frequently it has to be carried out by a specialist.

In particular, the extent of the height-adjustability of the table may be dimensioned such that an adjustment of the table top is possible between a seat height and a standing height. For example, the lower height of the table top as the seat height may be fixed at approximately 72 centimeters (cm) or cm or a different value between approximately 60 cm and approximately 85 cm and the upper height of the table top as the standing height may be fixed at approximately 105 cm or a different value between approximately 95 cm and approximately 125 cm.

By the at least one strap being able to be wound up onto the winding disk, the length thereof may be adjusted. The term "length" in this connection may refer, in particular, to an active length of the at least one strap. In this case, the effective length of the at least one strap may remain unaltered but, by being wound up and/or unwound, its active length alters. In other words, the length in which the at least one strap is effective as a suspension device for the table top may be adjusted, irrespective of the effective strap length. For example, the at least one strap may be wound up to 40%, so that its length and/or active length is still approximately 60% of its effective length.

A shortening of the length of the at least one strap may result in the table top, which is suspended via the at least one strap on the supporting structures, being lifted. Similarly, an increase in the length of the at least one strap may result in the table top being lowered. Thus by means of the winding disk the strap length and, as a result, the height of the table top may be adjusted efficiently in a stepless and accurate manner.

Additionally the winding disk is operatively coupled to the spring element. Since the spring element is tensioned to a maximum extent when the table top is at the lower height and tensioned to a minimum extent when the table top is at the upper height, the spring tension reduces with the increasing height of the table top. As a result, the lifting of the table top may be assisted by winding up the at least one strap onto the winding disk by means of a spring force of the spring element. This permits the raising of the table top to be able to be carried out comfortably and easily, even when the table top is relatively heavy and/or when it is loaded with relatively heavy goods.

At the same time the spring force of the spring element counters a lowering of the table top by unwinding the at least one strap from the winding disk. As a result, it may be achieved that the table top is at least partially supported during the lowering. An undesired sinking of the table top may be avoided.

The mechanism according to the invention thus permits a force-assisted stepless lifting and lowering of the table top. In this manner, the height of the table top may be accordingly adjusted manually in an efficient and comfortable manner corresponding to the needs of the user.

Preferably, the winding disk of the mechanism is mounted on a lower face of the table top, such that it is rotatable about an axis which extends substantially at right angles to the lower face of the table top. On a winding disk thus arranged, the at least one strap may be wound up efficiently on the side edge thereof and/or at the side. In this case, the side edge of the winding disk may be configured between the two surfaces thereof and/or may connect said surfaces together. A winding disk thus mounted on the lower face of the table top expediently permits the at least one strap to be wound up in a space-saving and undisruptive manner.

Preferably, the mechanism comprises a limiting device which limits a rotational movement of the winding disk in both rotational directions. The limiting device may comprise two stops which may be configured, for example, on the winding disk itself. The stops may bear against a different element in a specific rotational position of the winding disk and thus limit the rotational movement. By such a limiting device, the extent of a rotational movement of the winding disk may be predefined. As a result, the extent of the height-adjustability of the table top may be predetermined in an efficient manner.

Preferably, the spring element and the winding disk of the mechanism are adjusted such that a half revolution of the winding disk effects a doubling and/or halving of the spring force of the spring element. As a result, an approximately uniform support may be implemented in an efficient manner when adjusting the height of the table top.

Preferably, the mechanism comprises an eccentric, wherein the spring element is non-positively connected to the winding disk via the eccentric. By means of the eccentric a virtually uniform torque may be produced in a simple manner, irrespective of the tension of the spring element on the winding disk. As a result, by adjusting the height of the table top, the force for actuating the winding disk may be kept constant.

In this case, the eccentric is preferably configured as an eccentric disk which is arranged on the winding disk. This permits a simple, efficient and compact design of the eccentric and/or the combined eccentric-winding disk.

The spring element may be a torsion spring and/or torque spring and/or a spiral spring, such as for example a wound spiral spring or a coil spring. Such a torque spring may be applied, for example, directly to the winding disk and thus directly exert a rotational force on the winding disk. Preferably, however, the spring element is a linear spring and the mechanism comprises a cable, wherein the linear spring is connected to the winding disk via the cable. In this case, the term "cable" is understood as cables in the narrow sense and also other elongated, bendable and/or non-rigid elements. In particular, in the above sense cables encompass wire cables, cords, wires or the like. For connecting to the winding disk, the cable may be tightly screwed, clamped or fastened in a similar manner thereto. The linear spring may, for example, be a helical spring, spiral spring or a hydraulic spring. By means of such a linear spring coupled to the winding disk, a sufficiently large torque may be produced in an efficient manner on the winding disk.

In this case, the cable at its one longitudinal end is preferably fastened to the linear spring and at its other longitudinal end is fastened to the winding disk, wherein the cable extends along at least one part of the side edge of the eccentric disk. The term "side edge" in connection with the eccentric disk refers, in particular, to the peripheral surface which connects together the two surfaces of the disk.

Preferably, the mechanism comprises a locking portion, the winding disk being able to be blocked thereby in a plurality of different rotational positions. Since the winding disk may be blocked by means of the locking portion in different rotational positions, the table top may be arranged at different heights. As a result, the table top may be adjusted to a preferred height.

In this case, the locking portion preferably comprises a blocking element and a toothing which is configured on the winding disk and which comprises a plurality of teeth offset relative to one another in the rotational directions of the winding disk, wherein the blocking element is configured to engage at different positions in the toothing of the winding disk. The term "rotational direction" in connection with the winding disk may refer, in particular, to the directions in which the winding disk is rotated in order to wind up and/or unwind the at least one strap. Such a toothing permits an efficient and stable design of a finely adjustable locking portion. The table top may thus be easily adjusted in terms of height in a virtually stepless and/or finely stepped manner.

The blocking element in this case is preferably provided with an engagement portion, the blocking element being able to be actuated manually thereby. Such an engagement portion permits easy operation of the locking portion by the user.

The locking portion preferably comprises a pulling element which pulls the blocking element into the toothing. The pulling element may be a spring which, for example, is pretensioned. For releasing the locking portion, the blocking element, for example, may be moved manually counter to the pulling force of the pulling element out of the toothing, so that the winding disk is able to rotate freely. If the blocking element is released, it is pulled into the toothing by the pulling element and thus blocks the winding disk. The pulling element thus permits easy operation of the locking portion. Additionally, it may prevent the locking portion from remaining in an unblocked position and thus, for example, permitting the table top to be lowered inadvertently or to an undesirable extent.

Preferably, the two supporting structures are arranged in each case at the side of the table top, wherein the at least one strap connects together the supporting structures and the table top such that the table top is suspended between the two supporting structures.

The term "at the side" may refer to the side edges of the table top relative to the table top. In particular, the table top in this case may comprise a front edge facing a user of the table, a rear edge remote from the user of the table and two side edges connecting the front edge to the rear edge. In a rectangular or rectangular-like table top the side edges may correspond to the shorter sides of the rectangle and the front and rear edges in each case to one of the two longer sides of the rectangle. Since the table top is arranged between the supporting structures, it is able to be suspended in a relatively stable manner. An undesired rocking, for example in the lateral direction, may thus be curbed or avoided in an efficient manner.

Preferably, the table top comprises a lower face and an upper face and the at least one strap extends from one of the two supporting structures onto the lower face of the table top. The upper face of the table top may define a working and/or usable surface of the table. Since the at least one strap extends transversely below the table top, it may be achieved that relatively few straps have to be used for the stable suspension of the table top. Additionally, such a design permits a relatively simple adjustment of the height of the table top. For example, this may be achieved by the length of the strap being centrally altered and/or adjusted.

Preferably, the at least one strap encompasses four straps. The use of four straps, in particular extending transversely below the table top, permits the table top to be able to be held in a balanced and adjusted manner. Tilting and/or tipping of the table top to one side may be avoided. In addition, more than four straps may be present.

In this case, the table top preferably comprises a front edge, two side edges and a rear edge and the four straps are preferably mounted offset to one another on the supporting structures relative to the side edges of the table top.

Preferably, the table comprises deflection means arranged on the lower face of the table top, wherein the at least one strap is guided by the deflection means along the lower face of the table top. By means of the deflection means, the at least one strap may be guided along the lower face of the table top, such that the table top is supported in a stable and uniform manner. The deflection means may comprise straight or curved guide flanks, the at least one strap extending along said guide flanks. Such guide flanks permit an efficient guidance and deflection of the at least one strap in any direction.

Preferably, the supporting structures are designed as side walls. Such side walls permit a relatively simple design of stable supporting structures. Additionally, such side walls may serve for delimiting and/or for visual and sound protection of a work station, for example in an open-plan office. The side walls may be produced, for example, from wood or a plastics material.

In this case, the table preferably comprises a rear wall located between the side walls. By means of such a rear wall, the table top may be encompassed and embedded on three sides. At the same time, the supporting structures may be fixedly connected together. This may provide the table with increased stability. Additionally, the rear wall permits a further delimiting of the table from its surroundings. The rear wall may also be produced from wood or a plastics material and, in particular, from the same material as the side walls.

Preferably, a guide rail is arranged on at least one of the supporting structures and a guide element is arranged on an associated side edge of the table top, wherein the guide rail of the supporting structure cooperates with the guide element of the table top. In order to achieve a uniform guidance, in particular, on two or more supporting structures, a guide rail may be provided and a guide element may be provided on the associated sides and/or edges of the table top. By means of the guide rail and the guide element, a straight vertical movement of the table top may be ensured when adjusting the height thereof. As a result, the risk of a tilting and/or blocking of the vertical movement of the table top may be reduced.

Preferably, the table top is able to be tilted about a transverse axis relative to the two supporting structures between a horizontal position and a vertical position. In this manner, the table top may be designed to be able to be folded up which, in particular, may be desirable for stowage of the table in a space-saving manner.

In this case, the table top preferably comprises a plurality of rotary bearings assigned in each case to one of the supporting structures. In particular, two rotary bearings may be present. Such rotary bearings permit a relatively simple and reliable design of the tiltable table top. If the table is provided at the same time with guide rails and guide elements of the type described above, the guide elements may be mounted on the rotary bearings. This has the effect that the transverse axis may be located in a stable manner between the two rails.

Preferably, in this case the supporting structures are able to be at least partially folded in when the table top is folded into the vertical position. Such supporting structures which are able to be folded in, permit the table to be able to be stowed in a relatively space-saving manner.

Here, the supporting structures in each case preferably comprise a fixed portion and a folding portion connected in a foldable manner to the fixed portion. Such a two-part design of the supporting structures also makes it possible, in particular, for the supporting structures to be able to be folded-in efficiently and at the same time for said supporting structures to continue to ensure sufficient stability of the table construction when the supporting structures are configured as side walls.

Preferably, in this case, the folding portions of the supporting structures are connected in each case via a hinged joint to the fixed portion of the supporting structures. Such hinged joints permit a relatively simple and stable design of the supporting structures with a folding portion and a fixed portion, in particular, even when the supporting structures are configured as side walls.

BRIEF DESCRIPTION OF THE DRAWINGS

Further advantageous embodiments of the invention are disclosed from the following description of exemplary embodiments by means of the schematic drawings. In particular, the table according to the invention is described hereinafter in more detail with reference to the accompanying drawings by means of exemplary embodiments. In the drawings.

MEANS FOR IMPLEMENTING THE INVENTION

Figure 1:
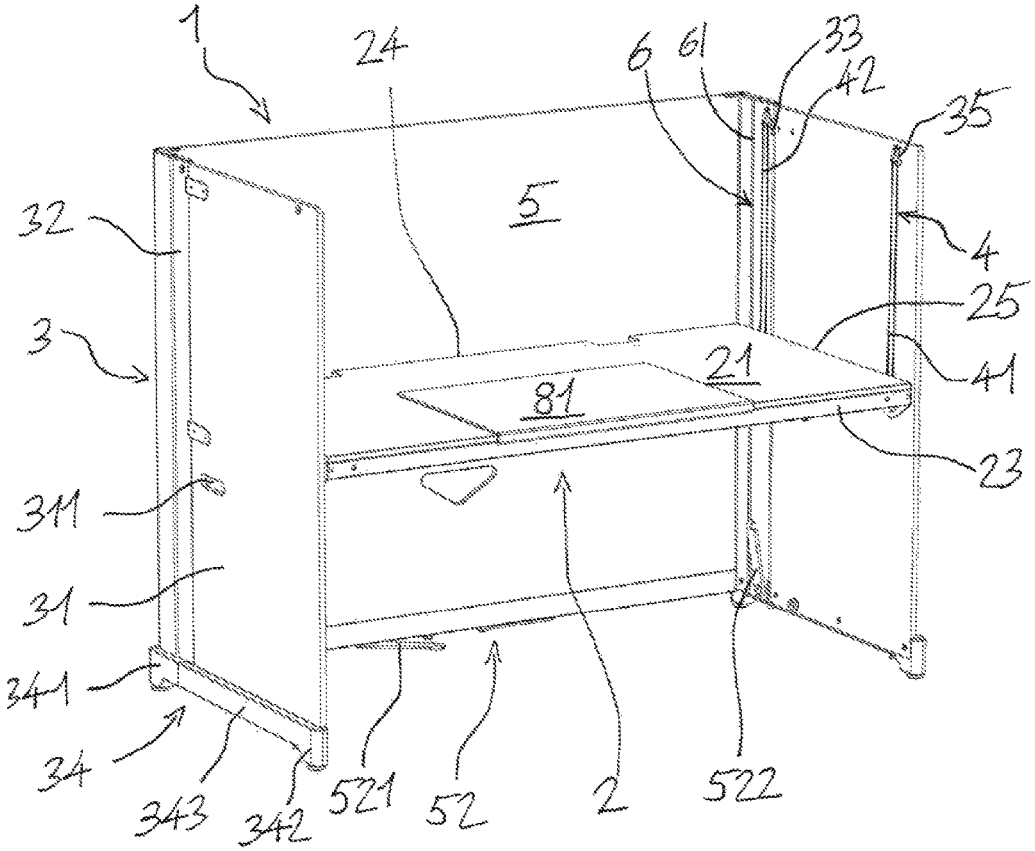
FIG. 1 shows a perspective view of an exemplary embodiment of a table according to the invention with a table top adjusted to the seat height.

Certain expressions are used in the following description for practical reasons and are not to be understood as limiting. The words "right", "left", "bottom" and "top" denote directions in the drawings to which reference is made. The expressions "inwardly" and "outwardly" and/or "rear" and "front" denote directions toward or away from the geometric center point of the table and known parts thereof. The terminology comprises the words expressly mentioned above, derivatives thereof and words of similar meaning.

FIG. 1 shows a first exemplary embodiment of a table 1 according to the invention which is height-adjustable and able to be folded up. The table 1 comprises a table top 2, two vertical side walls 3 as supporting structures and a vertical rear wall 5 connecting the side walls 3. The table top 2 comprises a substantially rectangular upper face 21, a rear edge 24 facing the rear wall 5, a front edge 23 opposing the rear edge 24 and two side walls 25 connecting in each case the rear edge 24 to the front edge 23. The side edges 25 form the short sides of the rectangular upper face 21 of the table top 2 and the front edge 23 and/or the rear edge 24 form the longitudinal sides thereof. Two recesses are incorporated in the rear edge 24, cables or the like being able to be pulled therethrough, for example, during use of the table 1.

The side walls 3 comprise in each case a fixed portion 32 fixedly connected at right angles to the rear wall 5 and a folding portion 31 foldably connected to the associated fixed portion 32 via in each case two hinges 33. In each case a horizontal slotted handle 311 is incorporated in the folding portions 31. At their lower end the side walls 3 in each case comprise a foot part 34 with a rear foot 341, a front foot 342 and a connecting bar 343 connecting the rear foot 341 to the front foot 342. In this case, the rear feet 341 are arranged adjacent to the rear wall 5 and the front feet 342 are arranged at one end of the folding portions 31 remote from the rear wall 5. The table 1 is positioned with the rear feet 341 and the front feet 342 on the floor, when used as intended.

At its lower end the rear wall 5 and the side walls 3 comprise a side wall fastening 52. The side wall fastening 52 comprises two folding-in locking arms 521 mounted on the rear wall 5 and two folding-out locking arms 522 mounted in each case on one of the two side walls 3. By means of the side wall fastening 52, the side walls 3 may be secured both in the folded-in state by means of the folding-in locking arms 521 and also in the folded-out state by means of the folding-out locking arms 522.

In each case a guide rail 61 of a table top guide 6 is arranged on the inner faces of the fixed portions 32 of the side walls 3. The guide rails 61 in each case extend vertically over the entire height of the associated fixed portion 32.

The table top 2 is fastened to the side walls 3 by means of four straps 4, two thereof being visible in FIG. 1. In this case, a first front strap 41 is mounted in the vicinity of an upper edge of the right-hand side wall 3 and remote from the rear wall 5 on the right-hand rear wall 3 by means of a strap fastening 35. A first rear strap 42 is mounted in the vicinity of the upper edge of the right-hand side wall 3 and in the vicinity of the rear wall 5 by means of a further strap fastening 35 on the right-hand side wall 3. The straps 4 extend below the table top 2.

In FIG. 1 the table top 2 is illustrated adjusted to a seat height and horizontally aligned, i.e. arranged with a horizontal upper face 21 and/or untilted. In this case, it is suspended between the side walls 3 on the straps 4. It is surrounded by the side walls 3 and the rear wall 5, and enclosed thereby. This lends the table top 2 stability and prevents an undesired rocking and/or tilting. The side walls 3 and the rear wall 5 protrude over the table top 2 in the vertical direction, i.e. upwardly. As a result, the upper face 21 of the table top 2 and, in particular, a work station formed thereby may be separated and/or protected from viewing and noise. A desk pad 81 is positioned on the upper face 21.

For all of the remaining description the following statement applies: if reference numerals are contained in a figure for the purpose of illustrative clarity but not mentioned in the immediately associated text of the description, reference is made to the explanation thereof in the previous description of the figures. If, moreover, reference numerals are mentioned in the text of the description directly belonging to a figure, and which are not contained in the associated figure, reference is made to the previous and/or following figures.

Figure 2:
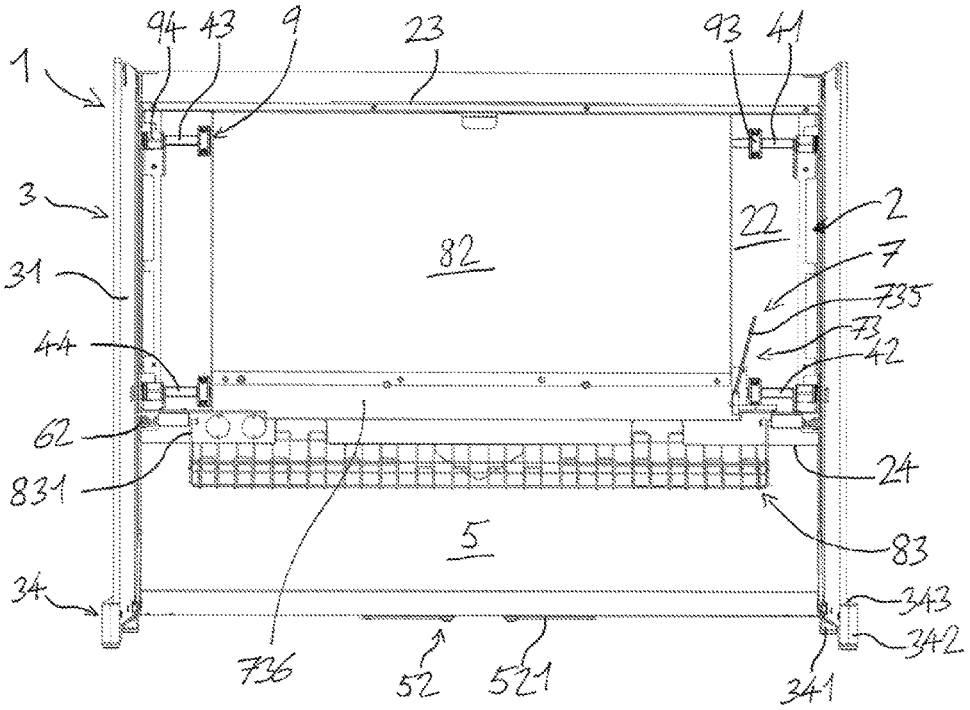
FIG. 2 shows a front view of the table of FIG. 1 with the table top fully tilted up.

In FIG. 2 the table 1 is shown from the front with the table top 2 fully folded up. The table top 2 in this position is aligned vertically. When the table top 2 is folded up the folding portions 31 of the side walls 3 may be folded inwardly by means of the hinges 33 (not shown in FIG. 2). When the folding portions 31 are folded inwardly, said folding portions are located parallel to the rear wall 5. The folding-in locking arms 521 of the side wall fastenings 52 may in this case fasten the folding-in portions 31 of the side walls 3 to the rear wall 5. Similarly, the folding-up locking arms 522 of the side wall fastening 52 are able to fix the folding-in portions 31 of the side walls 3 at right angles to the rear wall 5.

The table 1 in such a folded-in position forms a compact unit which may be stacked in a space-saving and efficient manner and which may be transported efficiently. No tools are required for folding up the table top 2 and for folding in the folding portions 31, and this may be carried out by the user himself/herself. The slotted handles 311 of the side walls 3 oppose slotted handles of the rear wall 5, so that the table 1 may be easily carried by one or two people thereby.

The table top 2 has a lower face 22 which is covered by a cover 82 when transported over long distances. From the right-hand side, the first front strap 41 and the first rear strap 42 extend below the cover 82. Similarly, from the left-hand side a second front strap 43 and a second rear strap 44 also extend below the cover 82.

The straps 4 are as a whole guided and deflected via a strap guide 9 as deflection means on the lower face 22 of the table top 2. As visible in FIG. 2, the strap guide 9 comprises in each case four entry guides 94 adjoining the side edges 25 and four transition mounts 93 in each case adjacent thereto. The straps 4 are horizontally guided in each case from an entry guide 94 and one of the transition mounts 93 from a side edge 25 of the table top 2 along the lower face 22 thereof below the cover 82. Two guide rollers 62 of the table top guide 6 are fastened at the side below the two lower entry guides 94, said guide rollers extending outwardly to the side of the table top 2.

Below the cover 82 a cable basket 83 is suspended on the lower face 22 of the table top 2. The cable basket 83 comprises lateral suspension brackets 831 via which it is mounted on corresponding bolts of the table top 2. In this case, the cable basket 83 is pivotably suspended on the lower face 22 of the table top so that in each case it is aligned horizontally in every tilted position of the table top 2. In this manner it is permitted that when tilting the table top 2 the cable basket 83 is not tilted therewith and emptied.

The table 1 further comprises an adjusting mechanism 7 as a mechanism, an actuating grip of a pretensioning ratchet 735 of a spring element 73 of said mechanism being visible in FIG. 2. Other parts of the spring element 73 are fitted into a spring protective cover 736 and covered thereby. The remaining parts of the adjusting mechanism 7 are also covered since they are located behind the cover 82. Accordingly, not all of these parts are shown in FIG. 2.

Figure 3:
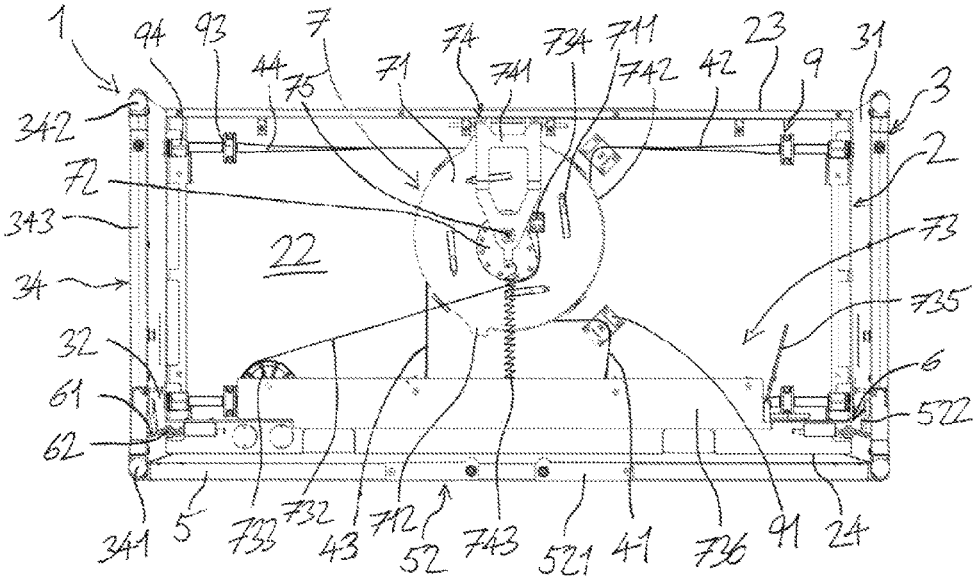
FIG. 3 shows a view from below of the table of FIG. 1, wherein a cover and a cable basket have been dismantled and wherein the table top is located at a lower height.

In FIG. 3, however, in which the table 1 is shown from below, the cover 82 is removed so that further parts of the adjusting mechanism 7 are visible. In particular, the adjusting mechanism 7 comprises a winding disk 71, an eccentric disk 72, the spring element 73, a locking portion 74 and a pivot pin 75.

The winding disk 71 is fastened in a planar and approximately central manner on the lower face 22 of the table top 2. In this case, the winding disk is mounted on the pivot pin 75 which extends at right angles from the lower face 22 of the table top 2, such that it is rotatable parallel to the lower face 22 of the table top 2. The surface thereof is thus aligned parallel to the lower face 22 of the table top 2. The surface of the winding disk 21 is substantially circular and the winding disk 71 is thus virtually circular disk-shaped. The winding disk 71 is able to be rotated via the pivot pin 75 centrally about the circle center of its surface.

The eccentric disk 72 is screwed onto the surface of the winding disk 71. It extends adjacent and parallel to the winding disk 71. The surface of the eccentric disk 72 is asymmetrically configured so that the eccentric disk 72 is not rotationally symmetrical.

The eccentric disk 72 is rotatably mounted together with the winding disk 71 on the pivot pin 75. Accordingly, it is also rotatable parallel to the lower face 22 of the table top 2. The pivot pin 75 penetrates the eccentric disk 72, but at an eccentric position in FIG. 3 offset upwardly from the center. This results in an unround rotational movement when the eccentric disk 72 is rotated about the pivot pin 75.

The spring element 73 comprises a spring cable 732 which protrudes from the spring protective cover 736. In this case the spring cable 732 is guided around a cable deflection wheel 733 and thus extends obliquely along the lower face 22 of the table top 2 in the direction of the eccentric disk 72.

Along the edge and/or rim thereof the spring cable 732 is deflected in the direction of a cable fastening 734. In the cable fastening 734 the spring cable 732 is fixedly mounted at one of its longitudinal ends.

The locking portion 74 comprises a blocking element 741 which comprises an engagement portion, a tensile spring 743 and a toothing 742, which is configured on the periphery of the winding disk 71. The toothing 742 is arranged between two stops 712 of the winding disk 71 as part of a limiting device. The tensile spring 743 is mounted at its one end with the blocking element 741 and at its other end on the spring protective cover 736. The tensile spring is pretensioned, whereby it pulls the blocking element 741 in the direction of the toothing 742. In this case, the blocking element 741 engages in the toothing so that the winding disk 71 and also the eccentric disk 72 are secured thereby, together with said winding disk, against a rotation about the pivot pin 75.

As visible in FIG. 3, the strap guide 9 comprises deflection elements 91 which deflect the first rear strap 42 and the first front strap 41 by approximately 90° toward the winding disk 71. The winding disk 71 has four fastening slots 711, in each case one of the straps 4 being mounted therein at its longitudinal end.

Figure 4:
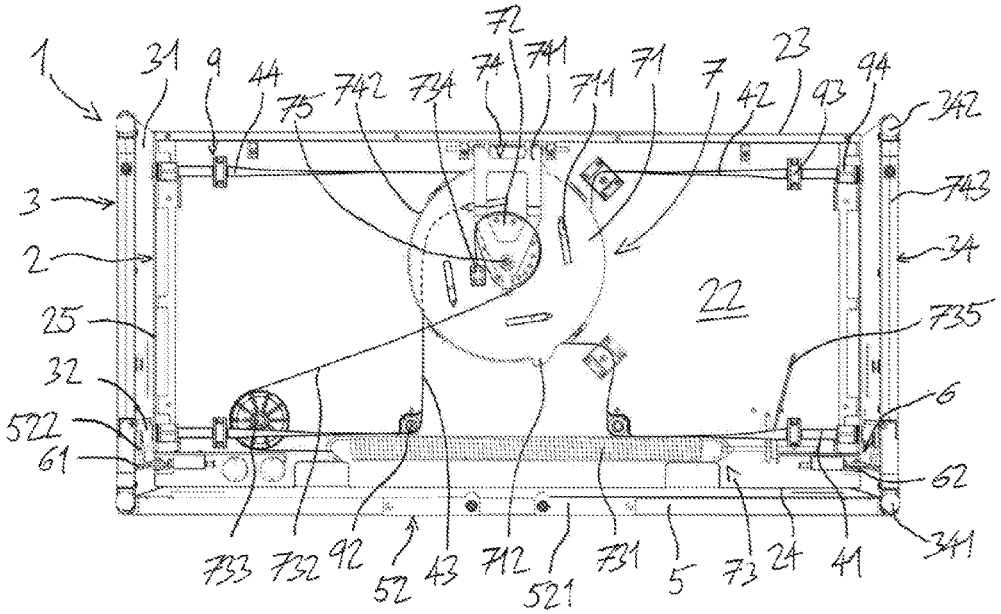
FIG. 4 shows a view of the table of FIG. 1 corresponding to the view of FIG. 3, wherein a spring mounting has been dismantled.

As is visible in FIG. 4, in which the spring protective cover 736 and the tensile spring 743 have been removed, the spring element 73 comprises a spiral spring 731 as a linear spring which is coupled at its one longitudinal end to the spring ratchet 735 and at its other longitudinal end to the spring cable 732. The spring cable 732 is thus tensioned between the spiral spring 731 and the cable fastening 734 via the cable deflection wheel 733 and the eccentric disk 72. The associated tensioning force may be adjusted as required via an actuation of the spring ratchet 735, by the spiral spring 731 being more or less pretensioned.

The strap guide 9 comprises two deflection rollers 92 which upwardly deflect the first front strap 42 and the second front strap 43 by approximately 90° in the direction of the winding disk 71 and/or in the direction of the associated deflection element 91. Using the second front strap 43, it is shown by way of example in FIG. 4 how the straps 4 are wound clockwise around the winding disk 71 and mounted in one of the four fastening slots 711. In this case, the first front strap 41 is mounted in the left-hand fastening slot 711, the first rear strap 42 is mounted in the lower fastening slot 711, the second front strap 43 is mounted in the upper fastening slot 711 and the second rear strap 41 is mounted in the right-hand fastening slot 711.

In the position shown in FIG. 4 of the table 1, the table top 2 is adjusted to the lower height. In this case, the winding disk 71 is rotated counterclockwise to a maximum extent until the stop 712 terminating the toothing 742 in the clockwise direction bears against the locking portion 74 (covered in FIG. 4 by the engagement portion of the blocking element 741 and therefore not visible). The straps 4 in this case are wound up to a minimum extent onto the winding disk 71 and accordingly have a maximum length, whereby the table top 2 is located at the lower height.

Since the spring cable 732 is guided counterclockwise around the eccentric disk 72 along its side edge, it is wound up to a maximum extent onto the eccentric disk 72 in the position of the table 1 of FIG. 4. Its length in this position is, therefore, minimal so that the spiral spring 731 is tensioned to a maximum extent. As a result, a maximum force acts from the spiral spring 731 onto the eccentric disk 72 and the winding disk 71. Since the eccentric disk 72 is shaped to be unround, it is ensured that the torque produced by the force of the spiral spring 731 via the eccentric disk 72 onto the winding disk 71, is approximately constant irrespective of the deflection of the spiral spring 731. Thus the raising and lowering of the table top 2 may be assisted uniformly, irrespective of the table top height.

Figure 5:
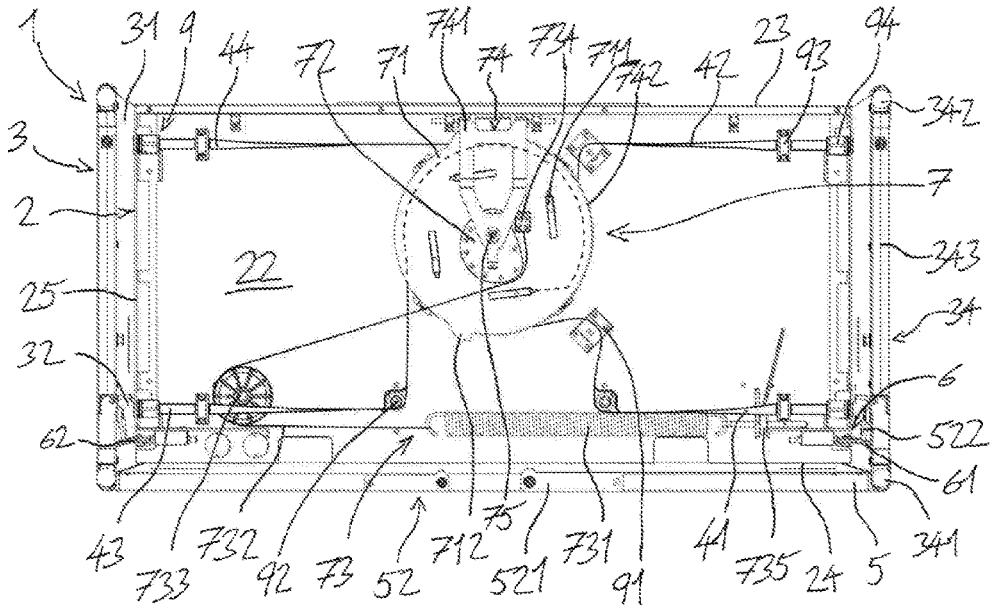
FIG. 5 shows a view of the table of FIG. 1 corresponding to the view of FIG. 4, wherein the table top is located at an upper height.

In FIG. 5 the table 1 is shown with the table top 2 at the upper height. In this case the winding disk 71 is rotated clockwise to a maximum extent until the stop 712 terminating the toothing 742 in the counterclockwise direction bears against the locking portion 74 (covered in FIG. 5 by the engagement portion of the blocking element 741 and therefore not visible). The straps 4 in this case are wound up onto the winding disk 71 to a maximum extent and have accordingly a minimum length, whereby the table top 2 is located at the upper height. In particular, the fastening slot 711 holding the first front strap 41 is located to the right, the fastening slot 711 holding the first rear strap 42 is located at the top, the fastening slot 711 holding the second front strap 43 is located at the bottom and the fastening slot 711 holding the second rear strap 44 is located to the left.

In the position of the table 1 of FIG. 5 the spring cable 732 is wound up to a minimum extent onto the eccentric disk 72. Its length in this position is, therefore, at a maximum so that the spiral spring 731 is tensioned to a minimum extent. As a result, a minimum force acts from the spiral spring 731 onto the eccentric disk 72 and the winding disk 71. Since the eccentric disk 72 is of unround shape, this minimum force acts with a relatively large lever force on the winding disk 71. Thus—as mentioned above—it is ensured that the torque produced by the force of the spiral spring 731 via the eccentric disk 72 onto the winding disk 71 is constant.

For adjusting the height of the table top 2 in a range between the lower height shown in FIG. 4 and the upper height shown in FIG. 5, the blocking element 741 of the locking portion 74 is manually pulled out of the teeth 742 of the winding disk 71 counter to the force of the tensile spring 743. Whilst the blocking element 741 is thus held, the table top 2 may be adjusted manually to a desired target height. In this case, the two guide rollers 62 of the table top guide 6 run in the guide rails 61, whereby the table top 2 may be moved up and down in a stable manner. Also this adjustment is assisted by the spring element 73, by the spring element initiating a downward movement and assisting an upward movement. If the table top 2 is located at the target height, the blocking element 741 is released again. The tensile spring 743 pulls the blocking element 741 into the toothing and thus fixes the table top 2 at the target height.

Figure 6:
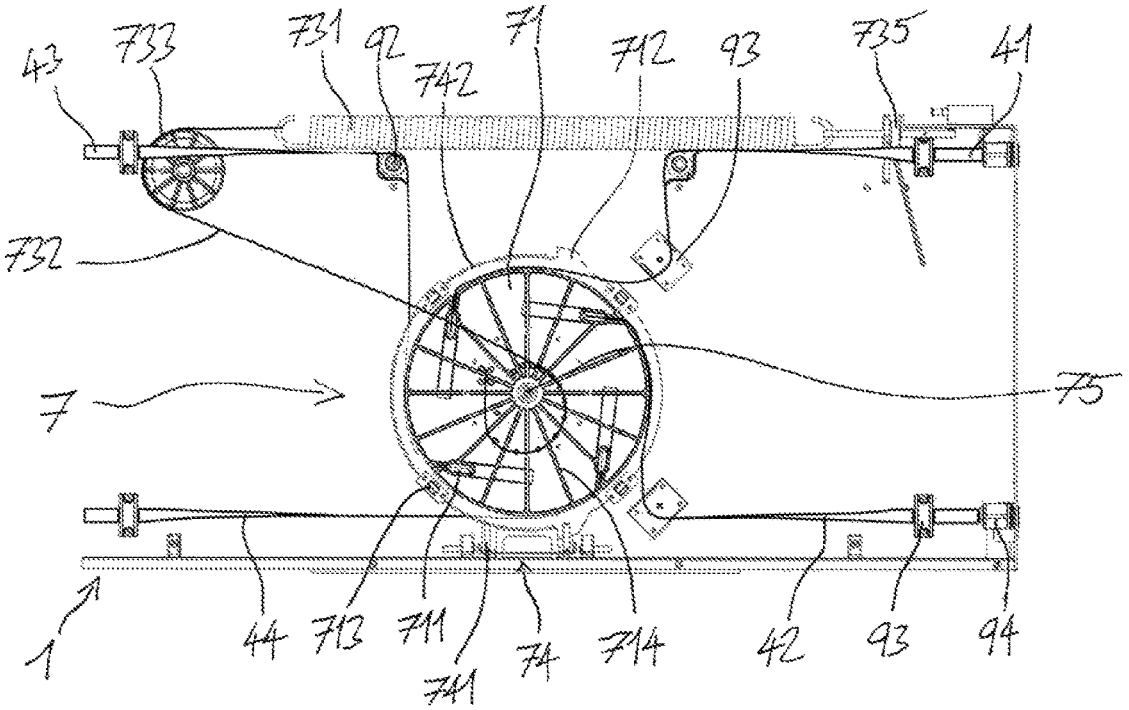
FIG. 6 shows a view from above of selected parts of the table of FIG. 1, wherein the table top is located at the upper height.

FIG. 6 shows the adjusting mechanism 7 of the table 1 from above, whilst the table top 2 (not shown in FIG. 6) is located at the lower height. In this case, the winding disk 71 is rotated counterclockwise to a maximum extent so that the stop 712 terminating the toothing 742 in the clockwise direction bears against the engagement portion of the blocking element 741 of the locking portion 74. The straps 4 are wound up to a minimum extent onto the winding disk 71. An engagement pin of the blocking element 741 engages in the toothing 742 of the winding disk 71 and thus blocks a rotational movement of the winding disk 71.

The winding disk 71 comprises in its interior a series of radial spokes 714. These spokes 714 permit the winding disk 71 to be of sufficiently stable design with a relatively low weight. Additionally, the winding disk 71 comprises four rollers 713 distributed uniformly along its circumference. The rollers permit the winding disk 71 to be able to be rotated with a relatively low resistance when bearing against the table top 2.

Although the invention has been shown and described in detail by means of the figures and the associated description, these drawings and this detailed description are to be understood as illustrative and exemplary, and not as limiting the invention. It goes without saying that the person skilled in the art may make alterations and modifications without departing from the scope of the invention.

The present disclosure also encompasses embodiments with any combination of features which are cited or shown above or hereinafter relative to different embodiments. It also encompasses individual features in the figures even when they are shown therein, in connection with other features, and/or are not cited above or hereinafter. Also, the alternatives of embodiments described in the figures and the description and individual alternatives of the features thereof are excluded from the inventive subject and/or from the disclosed subjects. The disclosure encompasses embodiments which exclusively encompass the features described in the claims and/or in the exemplary embodiments and also encompasses those embodiments which encompass other additional features.

Hereinafter the expression "encompass" and derivatives thereof do not exclude other elements or steps. Also, the indefinite article "a" and/or "an" and derivatives thereof do not exclude a plurality thereof. The functions of a plurality of features set forth in the claims may be fulfilled by a unit and/or a step. The terms "substantially" "approximately" "roughly" and the like in connection with a property and/or a value also define, in particular, just the property and/or just the value. The terms "approximately" and "roughly" in combination with a given numerical value or range, may refer to a value and/or range which is within 20%, within 10%, within 5% or within 2% of the given value and/or range. None of the reference numerals in the claims are to be understood as limiting the scope of the claims.

What is claimed is:

1. A table with a height-adjustable table top, supporting structures and at least one strap, in which the at least one strap connects the supporting structures and the table top together so that the table top is supported by the supporting structures by hanging on the supporting structures by means of the at least one strap, the table comprising:

a mechanism for manually adjusting a height of the table top, the mechanism comprising an eccentric, a winding disk which is rotatably mounted relative to the table top, and a spring element which is connected in strength to the winding disk via the eccentric, wherein the at least one strap is connected to the winding disk such that the at least one strap is configured to be wound up onto the winding disk, wherein the table top is adjustable between a lower height in which the at least one strap is wound up to a minimum extent onto the winding disk and an upper height in which the at least one strap is wound up to a maximum extent onto the winding disk, wherein the spring element is tensioned to a maximum extent when the table top is located at the lower height, and wherein the spring element is tensioned to a minimum extent when the table top is located at the upper height.

2. The table according to claim 1, wherein the winding disk of the mechanism is mounted on a lower face of the table top such that it is rotatable about an axis which extends substantially at a right angle to the lower face of the table top.

3. The table according to claim 2, wherein the mechanism further includes a limiting device which limits a rotational movement of the winding disk in both rotational directions.

4. The table according to claim 1, wherein the mechanism comprises a limiting device which limits a rotational movement of the winding disk in both rotational directions.

5. The table according to claim 1, wherein the spring element and the winding disk of the mechanism are adjusted such that a half revolution of the winding disk effects a doubling or a halving of the spring force of the spring element.

6. The table according to claim 1, wherein the eccentric is configured as an eccentric disk which is arranged on the winding disk.

7. The table according to claim 1, wherein the mechanism further includes a cable and the spring element is a linear spring which is connected to the winding disk via the cable.

8. The table according to claim 7, wherein the cable at its one longitudinal end is fastened to the linear spring and at its other longitudinal end is fastened to the winding disk, and wherein the eccentric is configured as an eccentric disk which is arranged on the winding disk and the cable extends along at least one part of a side edge of the eccentric disk arranged on the winding disk.

9. The table according to claim 1, wherein the supporting structures include a first supporting structure arranged at a first side of the table top and a second supporting structure arranged at a second side of the table top, and wherein the at least one strap connects the first supporting structure, the second supporting structure, and the table top together such that the table top is hanging between the first supporting structure and the second supporting structure.

10. The table according to claim 1, wherein the at least one strap includes four straps.

11. The table according to claim 1, further comprising deflection means arranged on a lower face of the table top, wherein the at least one strap is guided by the deflection means along the lower face of the table top.

12. A table with a height-adjustable table top, supporting structures and at least one strap, in which the at least one strap connects the supporting structures and the table top together so that the table top is supported by the supporting structures by hanging on the supporting structures by means of the at least one strap, the table comprising:

a mechanism for manually adjusting a height of the table top, the mechanism including a winding disk which is rotatably mounted relative to the table top, a spring element which is connected in strength to the winding disk, and a locking portion, the winding disk being configured to be blocked thereby in a plurality of different rotational positions, wherein the at least one strap is connected to the winding disk such that the at least one strap is configured to be wound up onto the winding disk, wherein the table top is adjustable between a lower height in which the at least one strap is wound up to a minimum extent onto the winding disk and an upper height in which the at least one strap is wound up to a maximum extent onto the winding disk, wherein the spring element is tensioned to a maximum extent when the table top is located at the lower height, and wherein the spring element is tensioned to a minimum extent when the table top is located at the upper height.

13. The table according to claim 12, wherein the locking portion includes a blocking element and a toothing which is configured on the winding disk and which includes a plurality of teeth offset to one another in the rotational directions of the winding disk, the blocking element being configured to engage at different positions in the toothing of the winding disk.

14. The table according to claim 13, wherein the blocking element is provided with an engagement portion by which the blocking element is manually actuatable.

15. The table according to claim 14, wherein the locking portion further includes a pulling element which pulls the blocking element into the toothing.

16. The table according to claim 13, wherein the locking portion includes a pulling element which pulls the blocking element into the toothing.

17. A table comprising:

a table top;

at least one supporting structure;

at least one strap, wherein the at least one strap connects the at least one supporting structure and the table top together so that the table top is supported by the at least one supporting structure by hanging on the at least one supporting structure by means of the at least one strap; and a mechanism configured for manual adjustment of a height of the table top, the mechanism being independent of a load placed on the table top, the mechanism including a winding disk which is rotatably mounted relative to the table top, wherein the at least one strap is connected to the winding disk such that the at least one strap is configured to be wound up onto the winding disk and wherein the table top is adjustable between a lower height in which the at least one strap is wound up to a minimum extent onto the winding disk and an upper height in which the at least one strap is wound up to a maximum extent onto the winding disk, a spring element which is connected in strength to the winding disk, wherein the spring element is tensioned to a maximum extent when the table top is located at the lower height and the spring element is tensioned to a minimum extent when the table top is located at the upper height, and an eccentric, wherein the spring element is connected in strength to the winding disk via the eccentric.

18. The table according to claim 17, wherein the eccentric is configured as an eccentric disk which is arranged on the winding disk.

* * * * *